US006601352B1

(12) United States Patent
Obermeyer et al.

(10) Patent No.: US 6,601,352 B1
(45) Date of Patent: Aug. 5, 2003

(54) INSULATED ATTIC ACCESS COVER

(75) Inventors: Keith G. Obermeyer, Hamel, MN (US); James S. Andrews, Medina, MN (US); David Wayne Koch, Coon Rapids, MN (US); John R. Twardy, Monticello, MN (US); Mark H. Theno, Minnetonka, MN (US)

(73) Assignee: Ado, Inc., Rogers, MN (US)

( * ) Notice: Subject to any disclaimer, the term of this patent is extended or adjusted under 35 U.S.C. 154(b) by 0 days.

(21) Appl. No.: 09/721,273

(22) Filed: Nov. 22, 2000

Related U.S. Application Data

(60) Provisional application No. 60/169,332, filed on Dec. 6, 1999.

(51) Int. Cl.[7] ..... E06B 3/26

(52) U.S. Cl. ..... 52/202; 52/19; 24/580.1

(58) Field of Search ..... 52/202, 203, 19, 52/20, 404.1, 407.2, 407.3; 411/551–553, 549, 550; 24/580.1, 580.11, 458, 578.17

(56) References Cited

U.S. PATENT DOCUMENTS

| | | | | | |
|---|---|---|---|---|---|
| 1,539,312 | A | * | 5/1925 | Holmes | 24/580.1 |
| 4,151,894 | A | | 5/1979 | Edwards | 182/77 |
| 4,185,433 | A | | 1/1980 | Cantrell | 52/404 |
| 4,502,368 | A | | 3/1985 | Hempel | 98/29 |
| 4,563,845 | A | * | 1/1986 | Stipe | 52/202 |
| 4,567,074 | A | | 1/1986 | Litaker | 428/71 |
| 4,581,861 | A | | 4/1986 | Eury | 52/95 |
| 4,658,555 | A | | 4/1987 | Steiner | 52/202 |
| 6,014,841 | A | * | 1/2000 | McCoy et al. | 52/19 |
| 6,269,597 | B1 | * | 8/2001 | Haas | 52/203 |

* cited by examiner

*Primary Examiner*—Carl D. Friedman
*Assistant Examiner*—Naoko Slack
(74) *Attorney, Agent, or Firm*—Vidas, Arrett & Steinkraus

(57) ABSTRACT

An insulated attic access cover which is easily installed from below the attic access opening and includes a flat panel with a central insulation portion, flanges which carry a seal and attachment points to secure the cover to the ceiling.

5 Claims, 1 Drawing Sheet

INSULATED ATTIC ACCESS COVER

CROSS-REFERENCE TO RELATED APPLICATIONS

This application is a utility application claiming priority from provisional application No. 60/169,332, filed Dec. 6, 1999, the entire contents of which are incorporated herein by reference.

STATEMENT REGARDING FEDERALLY SPONSORED RESEARCH

Not Applicable

BACKGROUND OF THE INVENTION

1. Field of the Invention

This invention relates to an insulated attic access cover to cover the opening into an attic.

2. Description of the Related Art

Homes usually have insulation, either as batting or blown in insulation in the attic. Attics are constructed to include an access point into which the attic may be reached. Usually, the attic is no longer used for storage and is accessed infrequently other than during construction when the insulation is installed. The opening into the attic must be closed to prevent heat loss in winter and unwanted heat gain in summer.

Often, the attic access is closed by a piece of drywall board cut to size and placed from the attic down against trim which has been cut to define a finished opening about the access opening. The trim presents a smaller opening than the drywall board so it doesn't fall through to the floor. In order to provide insulation, a piece of insulation batting may be cut to size and placed on top of the drywall board.

Drywall is a poor choice in that is cracks and breaks easily and gets dirty with handling. The insulation above the drywall board is difficult to handle when entering the attic and difficult to replace properly when leaving the attic and closing the opening.

Some of the prior solutions involve an insulated cover complete with a pull down stair. Edwards, U.S. Pat. No. 4,151,894 shows an insulating cover for pull down stairs. The cover is larger than the opening and must be deep enough to receive the folded stairs. Obviously, stairs are an added expense and may not be desired in many homes.

U.S. Pat. No. 4,658,555 to Steiner shows an attic hatchway cover that sits on top of an opening defined by trim boards from above. This type of cover requires the user to push it up and out of the way, usually leaving it on top of the attic insulation while entering the attic. This can cause attic insulation to be dislodged and fall onto the finished floor of the home.

U.S. Pat. No. 4,567,074 to Litaker adds an insulating panel to an existing attic closure door by making a picture frame type unit which has a central sheet of insulating board. It is attached to the existing closure by two screws.

U.S. Pat. No. 4,502,368 to Hempel shows an air vent cover which is often used to close attic openings in areas where louvers are used to allow air flow during one season and limit air flow in another season. It is attached around the ceiling opening with screws in keyways.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

BRIEF SUMMARY OF THE INVENTION

The invention provides an attic access cover that is attached to the ceiling below the attic opening. It includes a central tray portion that carries the insulation and has a peripheral flange which includes a seal to form a vapor barrier with the ceiling around the attic opening The attic access cover is preferably formed from molded plastic to lower cost and to provide an easily cleaned surface. The attic access cover includes several spaced guide holes in the flange that accurately guide placement of matching holes into the ceiling as attachment points. The attic cover may be placed over the attic opening from below and a drill can form the drill holes at each guide hole, either with the access cover in place as a template or after marking the needed holes. Depending on the type of ceiling, threaded anchors may be inserted into each drilled hole to provide a threaded opening for the attachment screws for removably securing the attic cover to the ceiling. Alternatively, the screws of the invention may be simply threaded into the drill holes formed.

The screws of the invention include a rotatable head which has a markedly different size in one dimension from the other. The guide holes in the flange are within a punch-out region in the flange that may be removed after having served as a template. The plastic is punched out leaving a defined opening that is longer in one dimension than the other, such as an ovoid. The head of the screws have a similar shape, and the screw head may be rotated 90 degrees such that without rotation the screw head easily passes into the punch-out opening but will not pass through when rotated 90 degrees into a locking engagement with the flange of the access cover.

In this manner, it is very simple to remove the attic access cover by simply turning each screw head 90 degrees. The cover may be replaced later and refastended by turning the screw heads 90 degrees.

Installation is simple and error free. The attic access cover acts as its own template for drilling the holes into the ceiling. The punch-outs are then removed and either threaded anchors are inserted into the drilled holes or screws with a threaded shaft are inserted into the ceiling. In either version, the rotatable heads allow the user to place the attic access cover over the screws at each punch-out and simply twist each head 90 degrees to firmly lock the cover to over the attic opening. A peripheral seal around the flange can help may the cover air-tight.

BRIEF DESCRIPTION OF THE SEVERAL VIEWS OF THE DRAWINGS

A detailed description of the invention is hereafter described with specific reference being made to the drawings in which.

DETAILED DESCRIPTION OF THE INVENTION

Figure 1:
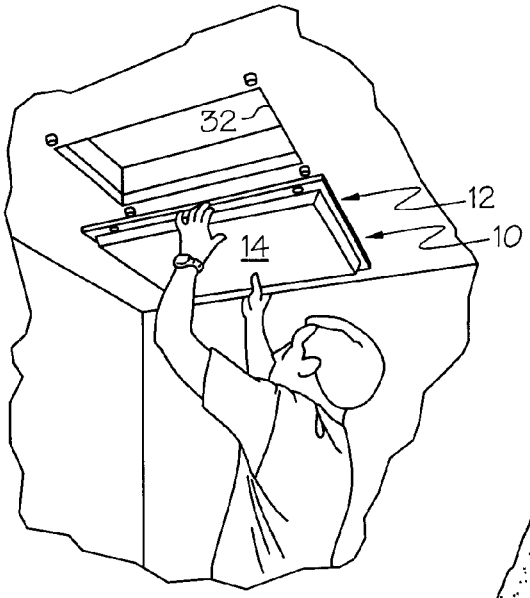
FIG. 1 is a perspective view of an installer positioning the attic cover of the invention over the previously positioned turnbuckle screws.
Figure 2:
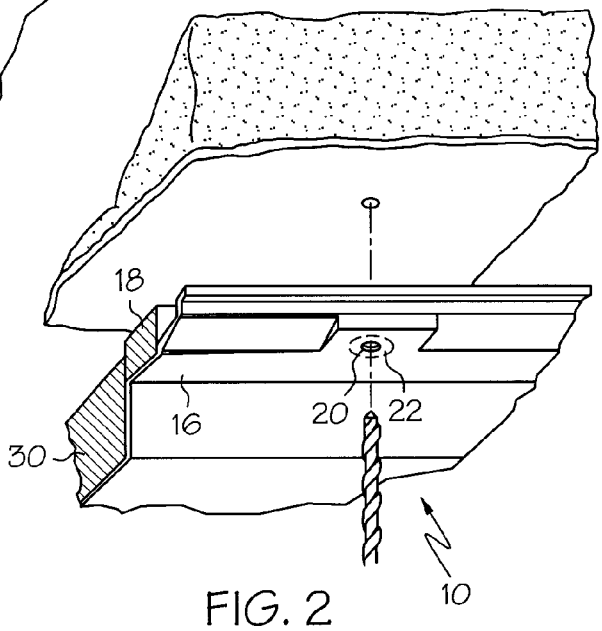
FIG. 2 is a partial perspective view of the attic cover showing how guide holes are used to accurately drill openings for threaded anchors.
Figure 3:
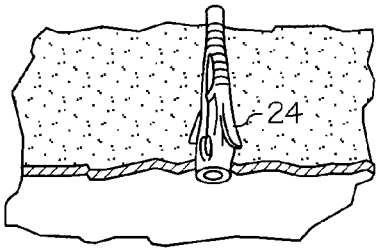
FIG. 3 is a view of a threaded anchor of the invention secured in place.
Figure 4:
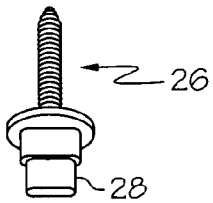
FIG. 4 is a side view of a turnbuckle screw of the invention.

With reference to the figures, the attic cover 10 of the invention is a generally rectangular, preferably molded plastic piece 12 which defines a central area 14 and an outer flange 16. The central area is sized to provide the insulation space and typically would hold a sheet of foam insulation 30. As seen in FIG. 1, the attic opening 32 typically is cut through ceiling wallboard and may or may not have a wooden frame into the attic. The attic cover 10 of the invention is sized to completely cover the opening with the insulated region.

Attic cover 10 preferably includes a gasket 18 around the flanges 16 to provide a better seal between the attic cover 10 and the ceiling. The invention provides an extremely easy mounting method which ensures that the homeowner can install the attic cover without damaging the ceiling finish.

The attic cover 10 includes a plurality of guide holes 20 molded into the flange 16 to serve as a template to mark the holes for the screws into the ceiling. In order the install the attic cover 10, the installer simply places the attic cover over the attic opening and the marks the drill hole locations onto the ceiling or drills through the guide holes 20. Although four guide holes 20 are shown, more may be desired for larger attic covers.

After the drill holes have been made, a threaded anchor 24 is installed into each drilled hole. Next, the installer punches out the oval punch-outs 22 molded into the flange 16 and screws the turnbuckle screws 26 of the invention into the threaded anchors 24. This may be done with or without the attic cover in place, since the turnbuckle screws 26 of the invention are simply rotated 90 degrees to either lock the attic cover 10 to the ceiling or are rotated 90 degrees to match the oval punch-outs 22 and allow the attic cover 10 to be removed.

The features of the invention make it nearly impossible to make a mistake in installing the attic cover. In addition, once installed, the attic cover may be quickly and easily removed from below by simply turning each turnbuckle 28 of the turnbuckle screws 26 ninety degrees. The attic may then be accessed without damaging the attic cover since it may be placed to the side until replaced. If the installer or attic accessor has dirty hands, the plastic attic cover 10 may simply be wiped clean, in marked contrast to cleaning of painted wallboard attic covers.

In addition to being directed to the embodiments described above and claimed below, the present invention is further directed to embodiments having different combinations of the features described above and claimed below. As such, the invention is also directed to other embodiments having any other possible combination of the dependent features claimed below.

The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. An attic access cover for covering an attic opening from below comprising:

(a) a generally rectangular tray defining a central region into which insulation may be placed;

(b) an integral peripheral flange around said tray encompassing an area larger than the attic opening to be covered;

(c) a plurality of guide holes spaced into said flange, which acts as a template for positioning the attic access cover, wherein each of said guide holes being centered in a removable oval punch-out formed in said flange which is temporarily kept in place and is later removed;

(d) a ceiling anchor mechanism for presenting a threaded opening into the ceiling to correspond to each guide hole; and (e) a turnbuckle screw for insertion into each anchor mechanism, said screw being constructed and arranged to include a head constructed and arranged to rotate at least 90 degrees.

2. The attic access cover of claim 1 further comprising insulation material within said tray.

3. The attic access cover of claim 2 wherein said insulation material is secured within said tray.

4. The attic cover of claim 1 wherein said head further being constructed and arranged to pass through said ovoid punch out in one position but not pass through in a position rotated 90 degrees therefrom.

5. An attic access cover for covering an attic opening from below comprising:

(a) a generally rectangular tray defining a central region into which insulation may be placed;

(b) an integral peripheral flange around said tray encompassing an area larger than the attic opening to be covered;

(c) insulation material within said tray;

(d) a plurality of guide holes spaced into said flange, each of said guide holes being centered in a removable ovoid punch-out formed in said flange which is temporarily kept in place and is later removed; and (f) a turnbuckle screw including a threaded shaft for securing said screw into a ceiling, said screw being constructed and arranged to include a head constructed and arranged to rotate at least 90 degrees, said head further being constructed and arranged to pass through said ovoid punch out in one position but not pass through in a position rotated 90 degrees therefrom.

* * * * *